United States Patent [19]

Clark

[11] 4,410,180

[45] Oct. 18, 1983

[54] PUZZLE

[76] Inventor: Melford D. Clark, 741 Piper La., Prospect Heights, Ill. 60070

[21] Appl. No.: 321,482

[22] Filed: Nov. 16, 1981

[51] Int. Cl.[3] ..... A63F 9/10

[52] U.S. Cl. ..... 273/156; 273/292

[58] Field of Search ..... 273/156, 157 R, 292, 273/294

[56] References Cited

U.S. PATENT DOCUMENTS

| | | | |
|---|---|---|---|
| 487,797 | 12/1892 | Thurston | 273/156 |
| 1,006,878 | 10/1911 | Rankin | 273/157 R |

FOREIGN PATENT DOCUMENTS

| | | | |
|---|---|---|---|
| 228590 | 2/1925 | United Kingdom | 273/157 R |
| 261680 | 11/1926 | United Kingdom | 273/157 R |
| 474026 | 10/1937 | United Kingdom | 273/157 R |

*Primary Examiner*—Anton O. Oechsle

*Attorney, Agent, or Firm*—Edmond T. Patnaude

[57] ABSTRACT

A number of square pieces having matching corner patterns and are arranged in sets so that each set may be assembled with the preceding sets to form a square in which the patterns on all mutually adjacent sides of the pieces match.

7 Claims, 2 Drawing Figures

PUZZLE

The present invention relates in general to puzzle type amusement devices, and it relates in particular to a novel puzzle consisting of a plurality of sets of square pieces which may be arranged in a unique manner to form a square in which visible patterns on the four corner portions of the pieces match together to form a predetermined, recognizable design.

BACKGROUND OF THE INVENTION

Puzzles in which a plurality of pieces are interfitted or otherwise mutually arranged so that visible patterns on the pieces are matched to form an overall design or picture are well known. As the parts of such puzzles are put together the degree of skill required to add another piece diminishes until the placement of the last piece requires very little, if any, skill at all. Consequently, the most difficult steps in solving such puzzles occur near the beginning and yet there is little sense of accomplishment until much of the puzzle has been completed.

It would be desirable, to provide a puzzle of this general type which becomes progressively more difficult as the parts are assembled. Moreover, it would be desirable to provide such a puzzle where the solution is carried out in a plurality of discrete steps so that the person or persons solving the puzzle have a sense of accomplishment as each step is completed.

SUMMARY OF THE INVENTION

Briefly, in accordance with the present invention there is provided a puzzle made up of a plurality of pieces of identical shape and size each having a unique visible design on the corner portions of the top face thereof. The tops and bottoms of the pieces are square and when the pieces are mutually arranged in a unique way they form a square with the designs on the individual squares matched to provide an overall recognizable pattern.

The pieces are provided in sets, there being $n^2-(n-1)^2$ pieces in each set wherefor there is one piece in the first set; three pieces in the second set; five pieces in the third set; and so forth. The pieces of each set are identified in any suitable manner to distinguish them from the pieces in the other sets. The puzzle is preferably solved starting with the first set, then assembling the pieces of the second set to the first set, and proceeding in this manner set-by-set until the puzzle is completed by assembling the last set. When properly assembled, each set and all of the pieces of the previously assembled set or sets form a square made up of pieces mutually arranged so that the individual designs on the respective pieces are intermatched to provide a recognizable pattern. In this way, the person doing the puzzle knows when each step of the puzzle has been properly solved since there is only one possible arrangement of all of the pieces of each set where the patterns on the pieces match the adjacent pieces in the same set as well as the adjacent pieces in the preceding set or sets.

In a preferred embodiment of the invention, the overall design on the face of each piece is made up of four corner patterns selected from five possible corner patterns, it having been determined that less than five patterns renders the puzzle easier to solve while six or more possible patterns makes it very easy to assemble the lower and higher numbered sets.

In a further preferred embodiment of the invention the corner patterns are quadrants of equal-size circles, squares or triangles each having a color selected from five different colors. Accordingly, a circle, square or triangle of one of the five colors is provided at the intersection of each four pieces in the unique predetermined configuration.

GENERAL DESCRIPTION OF THE DRAWING

The present invention will be better understood by a reading of the following detailed description taken in connection with the accompanying drawing wherein:

FIG. 1 is a perspective view of a portion of the puzzle of the present invention; and FIG. 2 is a plan view of a preferred embodiment of the present invention.

DETAILED DESCRIPTION OF A PREFERRED EMBODIMENT OF THE INVENTION

Figure 1:
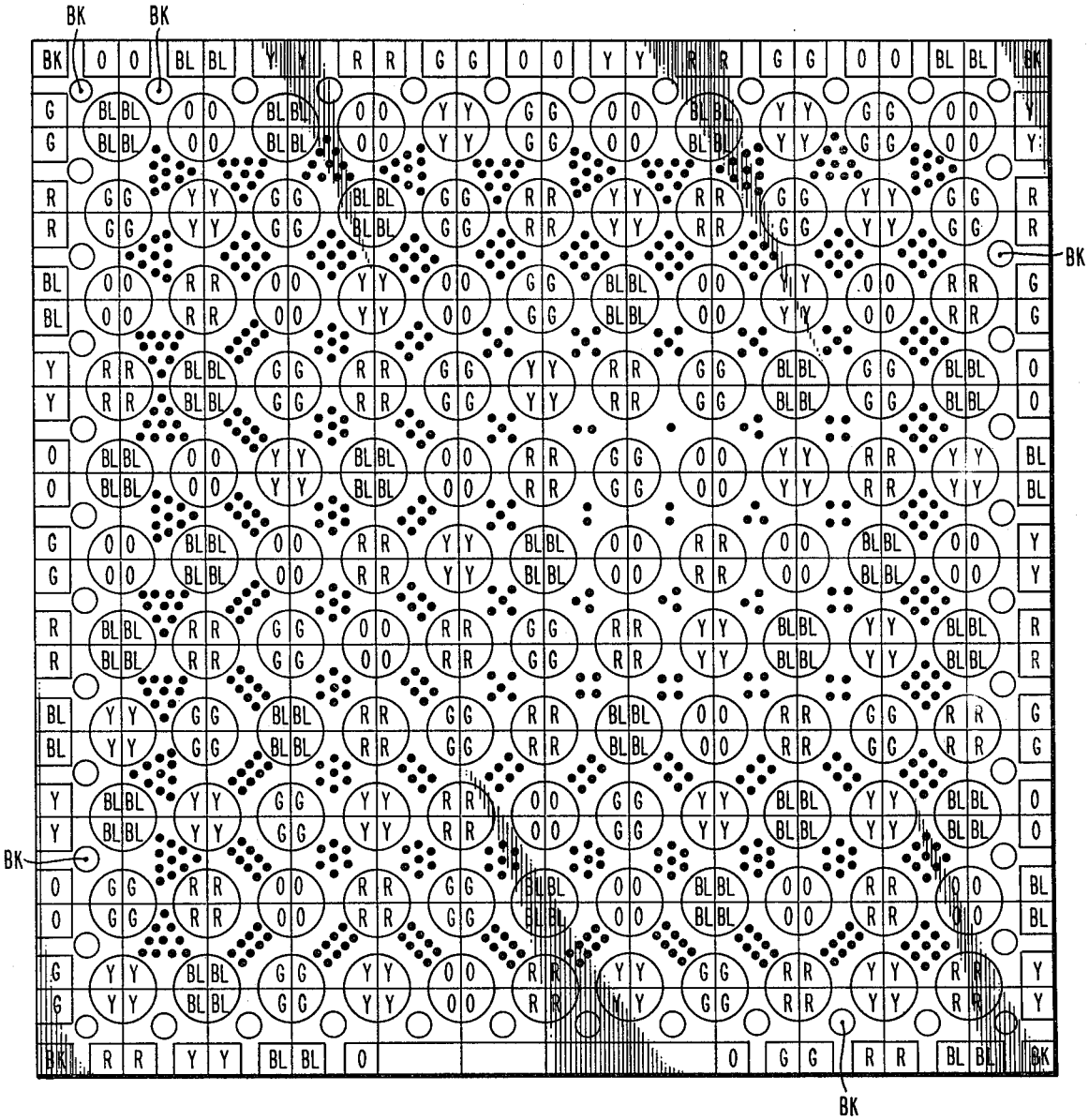

Referring to FIG. 1 there is shown the top view of one-hundred forty-four square playing pieces mutually positioned to form a twelve-by twelve square wherein the patterns on the top faces of the mutually adjacent pieces are matched in a unique, predetermined pattern. Each of the pieces is identical in size and shape to the other pieces but has a unique pattern on its top face. These patterns comprise four corner patterns with the corner patterns of the inner pieces having four quadrants of circles at the corners, which circles are of four colors selected from five possible colors. The five colors are green, blue, red, orange and yellow and these are respectively identified in the drawing as G, Bl, R, O and Y. The peripheral pieces have differently shaped corner patterns for esthetic purposes only. These latter pieces, when properly assembled, provide a generally linear margin with the four corner pieces having a black square, labeled Bk, in one corner.

The pieces of the puzzle are grouped into sets which are respectively provided with a number of dots equal to the order in which the set is to be assembled. When each set has been properly assembled with the preceding set, the played pieces form a perfect square with the mutually adjacent corner patterns being matched.

The number of pieces in each set is thus equal to $n^2-(n-1)^2$ where n is equal to the order of the set. It may thus be seen that there is only one piece in the first set and it has one centrally located dot to identify its set. Beginning at the upper left corner, as shown, and proceeding clockwise, the corner patterns of this piece are red, green, orange and green circular quadrants. Set two has three pieces each identified by two centrally located dots, and when these three pieces are mutually arranged with the single piece of the first set there is formed a two-by-two square wherein the mutually adjacent edges of all of the pieces match. This is a unique arrangement, enabling the puzzle to be solved in discrete steps. It may be seen from inspection of FIG. 1 that as each subsequent set of pieces is added, a larger square is formed and this is repeated set-by-set until the last or border set of pieces has been played. The border pieces are readily distinguishable from the interior pieces and require no set identifying indicia. Of course, the border pieces could be omitted if desired since the addition of each set of interior pieces forms a perfect square.

It will be seen from an inspection of FIG. 1 that the patterns of set identifying dots are oriented in different directions in each set so that the identifying dots will not in themselves provide a clue as to the manner in which the pieces must be mutually arranged. Of course, other means of identifying the pieces in each set can be used in place of the dots.

Figure 2:
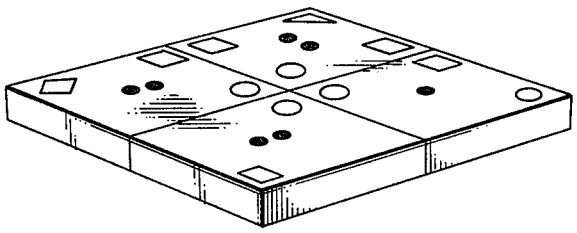

Referring to FIG. 2, there is shown in perspective a portion of a puzzle embodying the invention. In this embodiment of the invention the five possible matching corner patterns are four geometric shapes and one blank located in the respective corners of the pieces. The pieces are relatively thick hexahedrons such as conventional ceramic tiles. These patterns have the advantage that they may be of the same color and are not located at the edges of the pieces so as to reduce the manufacturing cost of the puzzle. Other shapes, symbols, alphanumeric characters or the like may be provided in the corner quadrants of the pieces if desired. The use of one blank pattern is economically advantageous in a multicolor puzzle such as the puzzle of FIG. 1 since it reduces the number of colors which must be printed.

As shown in FIGS. 1 and 2, the set identifying indicia, such as the dots, are located on the top faces of the pieces so as to be visible after the pieces have been arranged to avoid inadvertent movement of a piece from a previously completed set while assembling a subsequent set. If the set identifying indicia are located on the sides or bottoms of the pieces, the puzzle is much more difficult.

In the illustrated embodiments of the invention, the four corner patterns on each piece are selected from five possible corner patterns. While this appears to provide the best puzzle for the average person, the four corner patterns on each piece can be selected from a number of possible patterns greater than five or less than five thereby making the puzzle progressively easier in either instance.

It may thus be seen that the puzzle of the present invention is solved in discrete, sequential steps. Each succeeding step, i.e., assembling the next set of pieces, requires a greater degree of skill. The puzzle can thus be used as a learning tool for children wherein a greater sense of accomplishment or achievement is derived from assembling each successive set. While it is relatively easy to assemble the three pieces of set two to the single piece of set one, it is very difficult to assemble the nineteen pieces of set ten to the completed square of eighty-one pieces formed by sets one through nine. While the illustrated puzzle comprises ten sets of interior pieces and forty-four border pieces, if desired, additional sets of interior pieces may be used to increase the difficulty of the puzzle.

While the present invention has been described in connection with particular embodiments thereof, it will be understood by those skilled in the art that many changes and modifications may be made without departing from the true spirit and scope of the present invention. Therefore, it is intended by the appended claims to cover all such changes and modifications which come within the true spirit and scope of this invention.

What is claimed:

1. A puzzle comprising a plurality of pieces of the same size and geometrical configuration, each of said pieces having a square top surface, each of said top surfaces having thereon a unique visible pattern which matches with the patterns on other ones of said top surfaces of mutually arranged pieces only when said pieces are mutually arranged in side-by-side relationship in a unique predetermined recognizable configuration with the top surfaces of said pieces forming a square, said pieces being arranged in a plurality of sets with the first set of four pieces forming a first square, and the second set of five pieces when added to the first square forming a second square, said plurality of pieces in said first set being uniquely positionable to provide a predetermined recognizable pattern on the top surface of said first square, said plurality of pieces in said second set being uniquely positionable to provide a predetermined recognizable pattern on the top surface of said second square, and the pieces in each set having indicia on the top surface identifying the respective set of which they are a part, said set identifying indicia being devoid of information indicating the correct placement or orientation of the pieces.

2. A puzzle as set forth in claim 1 wherein indicia identifying the sequence in which the sets are arranged to form a complete square.

3. A puzzle as set forth in claim 2 wherein said patterns each comprise corner patterns selected from five different corner patterns.

4. A puzzle as set forth in claim 3 wherein said five corner patterns are of respectively different colors.

5. A puzzle as set forth in claim 4 wherein said five corner patterns are quadrants of a circle.

6. A puzzle according to claim 1 comprising a third set of seven pieces each geometrically identical to the pieces in said first and second sets with each piece of said third set having a unique visible pattern on the top surface thereof, said pieces in said third set being uniquely positionable adjacent to the pieces in said second square to provide a third square having a predetermined recognizable pattern on the top surface thereof.

7. A puzzle according to claim 6 comprising a fourth set of nine pieces each geometrically identical to the pieces in said first, second and third sets with each piece of said fourth set having a unique visible pattern on the top surface thereof, said pieces in said fourth set being uniquely positionable adjacent to the pieces in said third square to provide a fourth square having a predetermined recognizable pattern on the top surface thereof.

* * * * *